US012365430B2

(12) United States Patent
Jamieson

(10) Patent No.: US 12,365,430 B2
(45) Date of Patent: Jul. 22, 2025

(54) DEPLOYMENT OF UNMANNED UNDERWATER VEHICLES

(71) Applicant: Subsea 7 Limited, Sutton (GB)

(72) Inventor: James Andrew Jamieson, Balmedie (GB)

(73) Assignee: Subsea 7 Limited, Sutton (GB)

( * ) Notice: Subject to any disclaimer, the term of this patent is extended or adjusted under 35 U.S.C. 154(b) by 70 days.

(21) Appl. No.: 17/615,541

(22) PCT Filed: Jun. 5, 2020

(86) PCT No.: PCT/GB2020/051368
§ 371 (c)(1),
(2) Date: Nov. 30, 2021

(87) PCT Pub. No.: WO2020/245601
PCT Pub. Date: Dec. 10, 2020

(65) Prior Publication Data

US 2022/0227467 A1 Jul. 21, 2022

(30) Foreign Application Priority Data

Jun. 7, 2019 (GB) ..... 1908184

(51) Int. Cl.
*B63G 8/00* (2006.01)
*B63B 27/10* (2006.01)

(52) U.S. Cl.
CPC ..... *B63G 8/001* (2013.01); *B63B 27/10* (2013.01); *B63G 2008/007* (2013.01); *B63G 2008/008* (2013.01)

(58) Field of Classification Search
CPC ..... B63G 8/001; B63G 2008/007; B63G 2008/008; B63B 27/10; B63B 2027/165
See application file for complete search history.

(56) References Cited

U.S. PATENT DOCUMENTS 4,010,619 A 3/1977 Hightower et al.
5,042,415 A 8/1991 Hoffman
(Continued)

FOREIGN PATENT DOCUMENTS

CN 107472486 12/2017
WO WO 02/06146 1/2002
WO WO 2017/146583 8/2017

OTHER PUBLICATIONS

International Marine Contractors Association, IMCA R 018 "Guidelines for Installing ROV Systems on Vessels or Platforms," May 2013.

(Continued)

*Primary Examiner* — Andrew Polay
(74) *Attorney, Agent, or Firm* — Mattingly & Malur, PC

(57) ABSTRACT

A remotely operated vehicle (ROV) docked to a tether management system (TMS) is lifted outboard into water beside a vessel while deploying an umbilical that effects communication with the ROV via a tether of the TMS. After undocking the ROV to swim away from the TMS while deploying the tether, the TMS is suspended over the water while the ROV performs a subsea mission. A mobile or transportable ROV support unit can be positioned on a deck of a vessel of opportunity to facilitate deployment of the ROV, the TMS and the umbilical and to control the ROV during the mission.

15 Claims, 4 Drawing Sheets

(56) References Cited

U.S. PATENT DOCUMENTS

Figure 1:
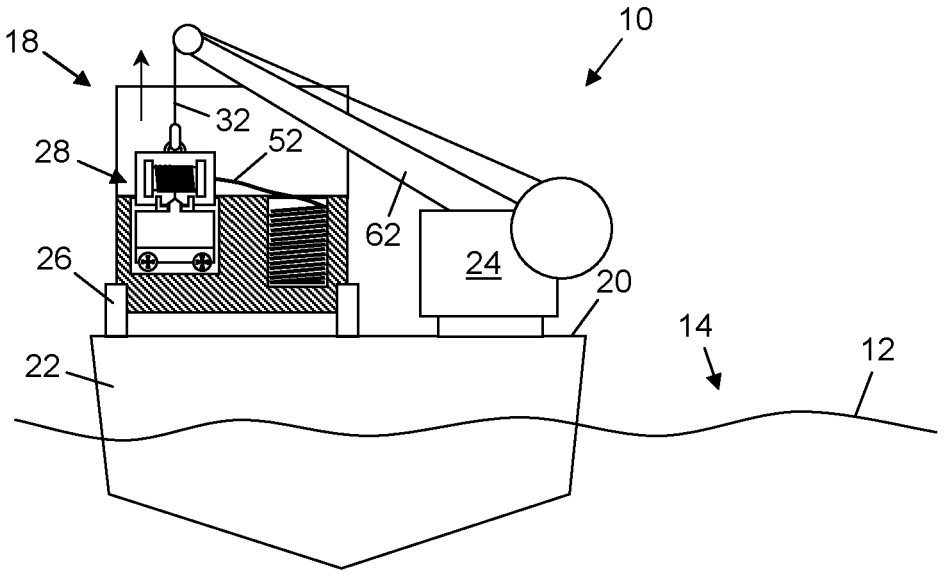

| | | | | |
|---|---|---|---|---|
| 6,390,012 | B1 * | 5/2002 | Watt | B63B 27/36 114/51 |
| 9,540,076 | B1 | 1/2017 | Trail | |
| 10,766,577 | B2 | 9/2020 | Hansen | |
| 2013/0011196 | A1 | 1/2013 | Brenner et al. | |
| 2016/0023722 | A1 | 1/2016 | Hesse | |
| 2017/0253301 | A1 | 9/2017 | Pfuetzenreuter et al. | |
| 2019/0054982 | A1 * | 2/2019 | Hansen | B63C 11/52 |
| 2019/0112011 | A1 * | 4/2019 | Trail | B63B 27/10 |
| 2019/0375482 | A1 * | 12/2019 | Hansen | B63C 11/42 |

OTHER PUBLICATIONS

Communication Pursuant to Article 94(3) EPC received in corresponding European Application No. 20 732 296.7 dated Nov. 10, 2023.

African Regional Intellectual Property Organization Office Action received in corresponding Application No. AP/P/2024/015565 dated Mar. 6, 2025.

* cited by examiner

DEPLOYMENT OF UNMANNED UNDERWATER VEHICLES

This invention relates to the deployment of unmanned underwater vehicles (UUVs) from surface vessels. UUVs are exemplified in this specification by remotely-operated vehicles (ROVs).

The invention is particularly concerned with enabling vessels of opportunity to be used for ROV deployment and not only specialised ROV support vessels (ROVSVs). In the context of the invention, a vessel of opportunity is a vessel that is not intrinsically designed, equipped and crewed to operate UUVs such as ROVs. A vessel of opportunity is instead designed primarily for other purposes, such as carrying supplies for offshore installations, items of equipment for installation subsea, or other cargo.

ROVs are commonplace for performing tasks underwater in depths or locations where the use of divers is not feasible or safe, especially in the subsea oil and gas industry. ROVs can be described either as free-flying ROVs or as tether-controlled ROVs, as taught by U.S. Pat. No. 9,540,076. Small observation-class or inspection-class ROVs may be used for underwater monitoring or inspection tasks. Larger work-class ROVs may be used for underwater work or subsea intervention tasks.

IMCA R 018 Guidelines for Installing ROV Systems on Vessels or Platforms published by the International Marine Contractors Association describes the main methods for launching an ROV from a surface vessel into the sea. Those guidelines explain that over-the-side deployment may be employed on a vessel of opportunity or by an ROV handling system installed permanently on an ROVSV. The alternative of deploying the ROV through a moonpool can cope with higher sea states but inevitably requires permanent installation and a specialised vessel.

When overboarding an ROV over the side of a vessel, a dedicated A-frame may carry a tether management system (TMS) to which the ROV is initially docked to form a TMS/ROV assembly. The TMS stores a tether that effects power and data connections with the ROV. An umbilical effects power and data connections between the vessel and the TMS and hence, via the tether, with the ROV.

U.S. Pat. No. 5,042,415 discloses an A-frame system for a free-flying ROV. WO 02/06146 exemplifies a TMS. U.S. Pat. No. 4,010,619 discloses a typical tethered ROV with a TMS.

Typically, an A-frame lifts and luffs a TMS/ROV assembly outboard, suspended from an umbilical. The umbilical is paid out from a winch beside the A-frame and runs over a sheave on the A-frame until the TMS/ROV assembly reaches the required depth in the water. The ROV then undocks from the TMS underwater, whereupon the TMS deploys the stored tether and remains underwater while the ROV performs its subsea mission. By using an intermediate TMS, the ROV is decoupled from motion of the vessel and is able to operate across a larger radius.

It will be apparent that the umbilical is used as a lifting cable and so must be able to withstand tension arising from the suspended weight of the TMS/ROV assembly. The thickness of the weight-bearing umbilical therefore limits the depth to which the TMS/ROV assembly can be delivered, for a given size and capacity of winch. This problem is of course exacerbated if the umbilical has to support the weight of a heavier work-class ROV. There is also a need for dedicated structures and equipment on the deck of the vessel, which militates against the use of a vessel of opportunity.

Rapid deployment platforms are known for use with small ROVs, namely observation-class or inspection-class ROVs. Such platforms comprise an umbilical winch on a mobile A-frame structure that carries a cage for the ROV. An example is offered by Seatronics Limited of Aberdeen, UK for its Predator ROV system (trade marks acknowledged). Again, the umbilical must bear the weight of the ROV and its cage, restricting use of the system to inspection tasks in shallow water such as in quays, harbours or ports.

Other efforts have been made to enable ROV deployment without requiring a surface vessel or platform to be fitted with specialised deployment equipment. For example, WO 2017/146583 describes the use of a deployment module to carry a TMS/ROV assembly. The deployment module can be lifted inboard and outboard by a crane of a vessel or platform. The deployment module is fitted with a winch that carries a weight-bearing umbilical, capable of supporting the weight of the TMS/ROV assembly.

In WO 2017/146583, the crane of the surface vessel or platform lifts the deployment module from an inboard position on the deck of the vessel or platform to an outboard position over the sea. A power and signal cable connects the deployment module to the vessel or platform.

With the deployment module held by the crane above the surface of the sea, the TMS/ROV assembly is disengaged from the deployment module and, while suspended by the umbilical, lowered by the winch to the seabed. The weight of the TMS/ROV assembly is therefore transferred initially from the deployment module to the umbilical and then from the umbilical to the seabed.

The deployment module is then lifted back onto the deck of the vessel or platform with the umbilical, now slack, extending over the side of the vessel and down to the TMS/ROV assembly. The ROV can then undock from the TMS, swimming away from the TMS on a tether to perform a subsea mission.

On completing the subsea mission, the ROV docks again with the TMS on the seabed and the deployment module is lifted by the crane again to the outboard position over the sea. The winch on the deployment module then winds in the umbilical, lifting the TMS/ROV assembly from the seabed and eventually out of the water and back into engagement with the deployment module. The weight of the TMS/ROV assembly is therefore transferred initially from the seabed to the umbilical and then from the umbilical to the deployment module. Finally, the deployment module is lifted back onto the deck of the vessel or platform, carrying the TMS/ROV assembly with it.

The solution proposed in WO 2017/146583 is complex and yet is not capable of delivering the TMS/ROV assembly to a mid-water depth above the seabed, if required. Also, in essence, the umbilical winch is merely moved from the deck of the vessel or platform to the deployment module. The problems of a lengthy weight-bearing umbilical remain.

Against this background, the invention provides a method of deploying a UUV from a surface vessel or platform to perform a mission underwater. The method comprises: moving the UUV, docked to a TMS, outboard from the vessel or platform and into water beside the vessel or platform; deploying an umbilical that extends outboard from the vessel or platform to the TMS to effect communication with the UUV via a tether of the TMS; undocking the UUV from the TMS; swimming the UUV away from the TMS while deploying the tether; and while suspending the TMS over the water beside the vessel or platform, using the UUV to perform the mission while communicating with the UUV via the tether and the umbilical.

The UUV is preferably fully submerged in the water before being undocked from the TMS. The TMS may also be submerged in the water before the UUV is undocked from the TMS. In that case, the TMS is then lifted and held clear of the water while the undocked UUV performs the mission.

Conveniently, a crane may be used to lift the UUV and the TMS outboard from the vessel or platform and to suspend the TMS over the water. Efficiently, that crane may be a crane forming part of the equipment fitted to the vessel or platform.

During the mission, the suspended TMS may be moved up and down relative to the vessel or platform in compensation for heave of the vessel or platform. The suspended TMS may also be stabilised with elongate links such as tag lines that extend from the vessel or platform to the TMS.

The umbilical may be deployed in response to outboard movement of the TMS from the vessel or platform, for example by being pulled from a storage location by virtue of the outboard movement of the TMS.

The method of the invention may further comprise the preliminary step of positioning a mobile UUV support unit on a deck of the vessel or platform. Then, the UUV and the TMS may be moved from the UUV support unit outboard of the vessel or platform. The umbilical may also be deployed from storage on the UUV support unit.

Communication with the UUV may be effected via the UUV support unit. For example, the UUV may be controlled from the UUV support unit, potentially using control personnel located onboard the UUV support unit.

The method of the invention may further comprise the subsequent step of returning the UUV to the TMS after the mission, while retracting the tether, and then docking the UUV with the TMS. For this purpose, the TMS may be lowered into the water before docking the UUV with the TMS underwater.

A UUV is apt to be deployed from a vessel of opportunity by adapting that vessel in accordance with the invention. Thus, the inventive concept also embraces a method of adapting a vessel of opportunity to support UUV operations. That method comprises positioning a mobile UUV support unit on a deck of the vessel, the UUV support unit including a UUV control system and a garage holding an assembly of a TMS and a UUV. Subsequently, the assembly of the TMS and the UUV may be lifted from the UUV support unit to a position outboard of the vessel, using a crane fitted to the vessel.

The UUV support unit may further include a storage location for an umbilical that connects the TMS to the UUV control system. The UUV control system may be arranged to accommodate control personnel for controlling the UUV. Data communication may be effected between the UUV control system and a control system of a crane fitted to the vessel.

Correspondingly, the inventive concept extends to a mobile or transportable UUV support unit that can be positioned on a deck of a surface vessel or platform. The UUV support unit includes: a UUV control system; a garage holding an assembly of a TMS and a UUV; a lifting formation on the TMS for lifting the TMS/UUV assembly from the garage using a crane; and an umbilical that effects communication between the UUV control system and the UUV via a tether of the TMS. The UUV support unit may comprise wheels, tracks and/or rollers enabling the support unit to move around the deck of the surface vessel or platform. The UUV support unit may be embodied as a vehicle.

The inventive concept also embraces a surface vessel or platform that is equipped with the UUV support unit of the invention. Conveniently, the UUV support unit may be positioned within a lifting radius of a crane fitted to the vessel or platform, whereby that crane can lift the TMS/UUV assembly from the garage of the UUV support unit. The UUV control system of the UUV support unit may be in data communication with a control system of the crane.

In summary, the invention provides techniques for deploying a subsea vehicle such as an ROV, or a package that requires a control umbilical, from the deck of a vessel and into the sea. Correspondingly, the invention also provides techniques for returning the vehicle or package from the sea and back to the deck of the vessel.

In embodiments to be described, a control umbilical or tether for the vehicle or package is fitted to a drum located in a frame of a TMS. The frame includes a control system for managing pay-in and pay-out of the tether, a latch that secures the vehicle or package mechanically to the frame for lifting as an assembly, and a lifting point that is suitable for lifting the complete frame and vehicle assembly into and out of the water. A short surface umbilical or cable links the tether on the drum to a surface control system that controls the vehicle.

To launch the vehicle, a crane of the vessel lifts the vehicle latched to the frame from the deck and locates the frame and the vehicle over the sea as a single package. The crane then lowers the frame and the vehicle into the water to a depth of a few metres. The now neutrally-buoyant vehicle unlatches from the frame, the tether is paid out and the vehicle is free to operate to perform a subsea mission. The frame is then lifted clear of the water and stabilised using the crane lift line and fore and aft guide wires. Recovery of the vehicle is a reverse of the process.

The invention has several advantages. For example, no dedicated ROV launch and recovery system (LARS) needs to be fitted to the vessel. The crane of the vessel provides all of the lifting capability that is required, including heave compensation if available.

The system of the invention can be rapidly mobilised to a vessel, without requiring welding or fabrication. Conversely, the system can be removed easily from the vessel or moved aside when no longer required, freeing up valuable deck space for other requirements.

Thus, the invention provides for rapid mobilisation of a task-optimised vehicle or package onboard a vessel to deliver a desired service. There is no requirement for deck-mounted LARS or supporting structures that are expensive and time-consuming to mobilise.

The invention also enables a modular system to be adopted, in which a deployed vehicle or package can be specific to a particular subsea task. When required, the crane can lift and deploy a different vehicle or package optimised for a different task, potentially choosing from a selection of vehicles or packages provided on a deck of the vessel.

Embodiments of the invention provide a system for quick deployment of an ROV from a vessel of opportunity. The system comprises a mobile support, such as an ROV van, comprising a garage location for an assembly of a TMS and an ROV. The TMS/ROV assembly is connected to the mobile support by a short umbilical, which is preferably less than 100 m long. The umbilical may be spooled inside a storage compartment or on a winch of the mobile support when not in use.

The TMS comprises lifting provisions whereby the TMS/ROV assembly can be lifted by any vessel crane. The ROV can be uncoupled from the TMS mechanically while remaining connected to the TMS via a tether or other communications link.

The TMS may be held above the water when the ROV is diving. Tag lines may extend between the suspended TMS and the vessel, at least when the ROV is diving.

Embodiments of the invention also implement a method to deploy an ROV quickly from a vessel of opportunity. The method comprises: fastening a mobile support on a deck of the vessel; using a crane of the vessel to lift an assembly of a TMS and an ROV from the mobile support, with the TMS/ROV assembly connected by an umbilical to the mobile support; lowering the TMS/ROV assembly until at least the ROV is in water; decoupling the ROV from the TMS; paying out an ROV tether from the TMS; and operating the ROV while the TMS remains suspended above the water.

Keeping the TMS above water close to the surface allows the umbilical to be simple, short and easy to manage. Also, only one winch needs to be used in the system, namely the winch of the TMS, compared to at least two winches in the closest prior art.

Whilst the invention facilitates ROV deployment from a vessel of opportunity, the invention could be used to provide additional ROV-operating capacity for any vessel, including a specialist ROVSV.

Thus, in accordance with the invention, an ROV docked to a TMS is lifted outboard into water beside a vessel while deploying an umbilical that effects communication with the ROV via a tether of the TMS. After undocking the ROV to swim away from the TMS while deploying the tether, the TMS is suspended over the water while the ROV performs a subsea mission. A mobile or transportable ROV support unit can be positioned on a deck of a vessel of opportunity to facilitate deployment of the ROV, the TMS and the umbilical and to control the ROV during the mission.

Figure 2:
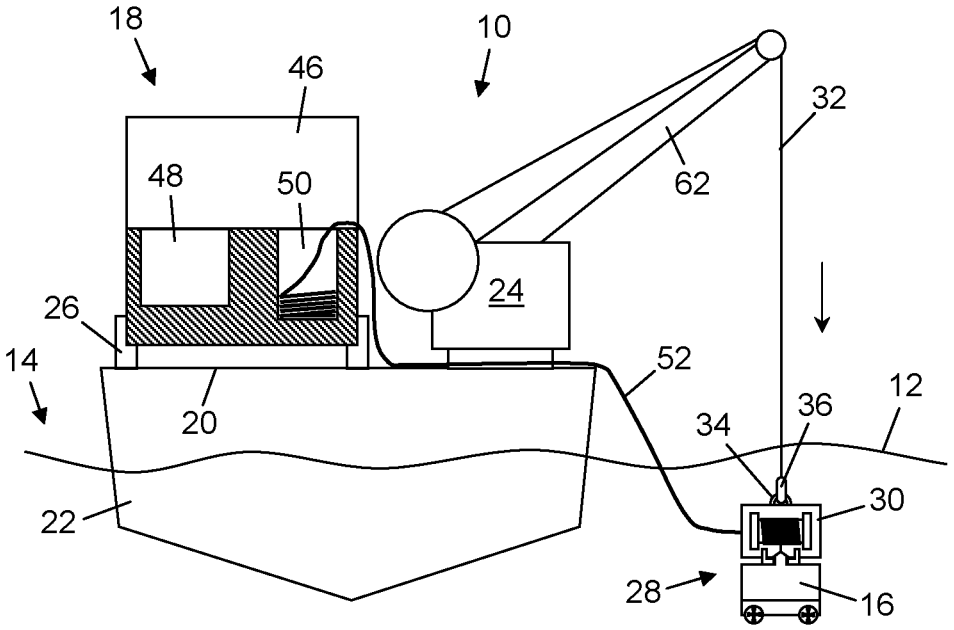
Figure 3:
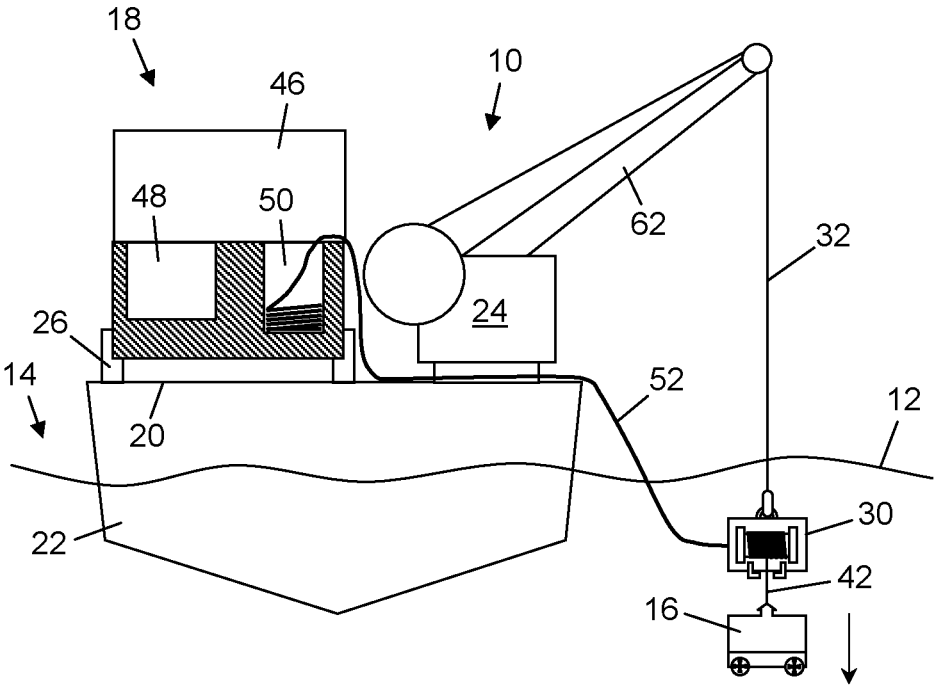
Figure 4:
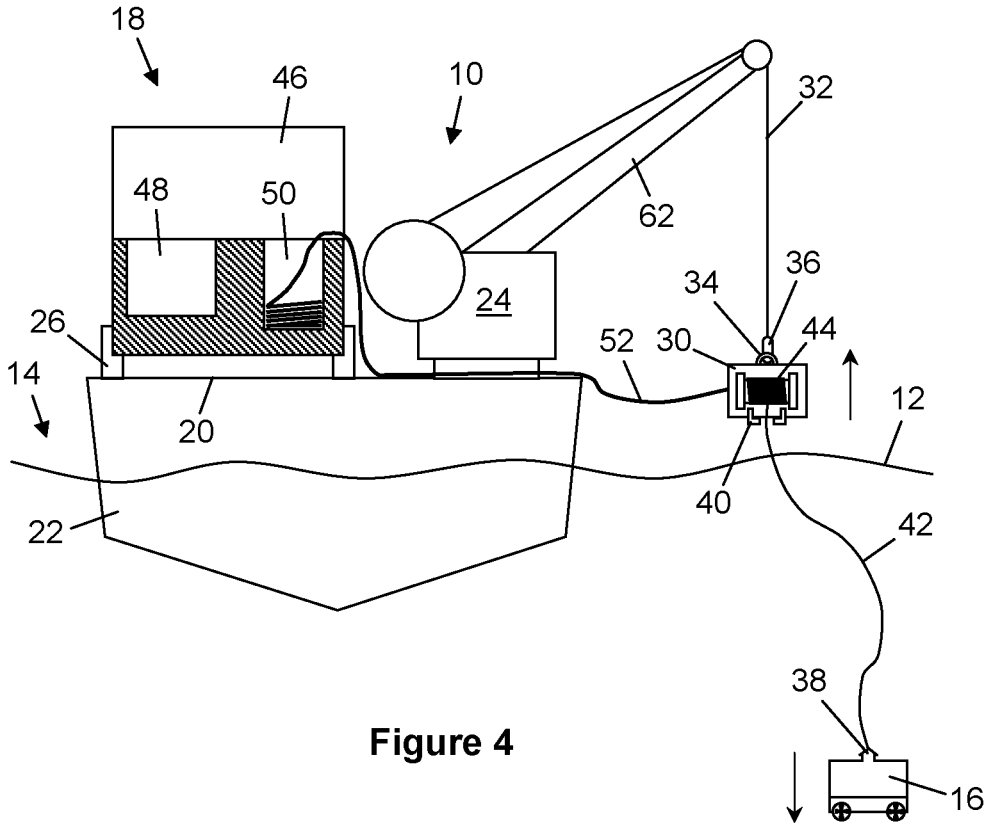
Figure 5:
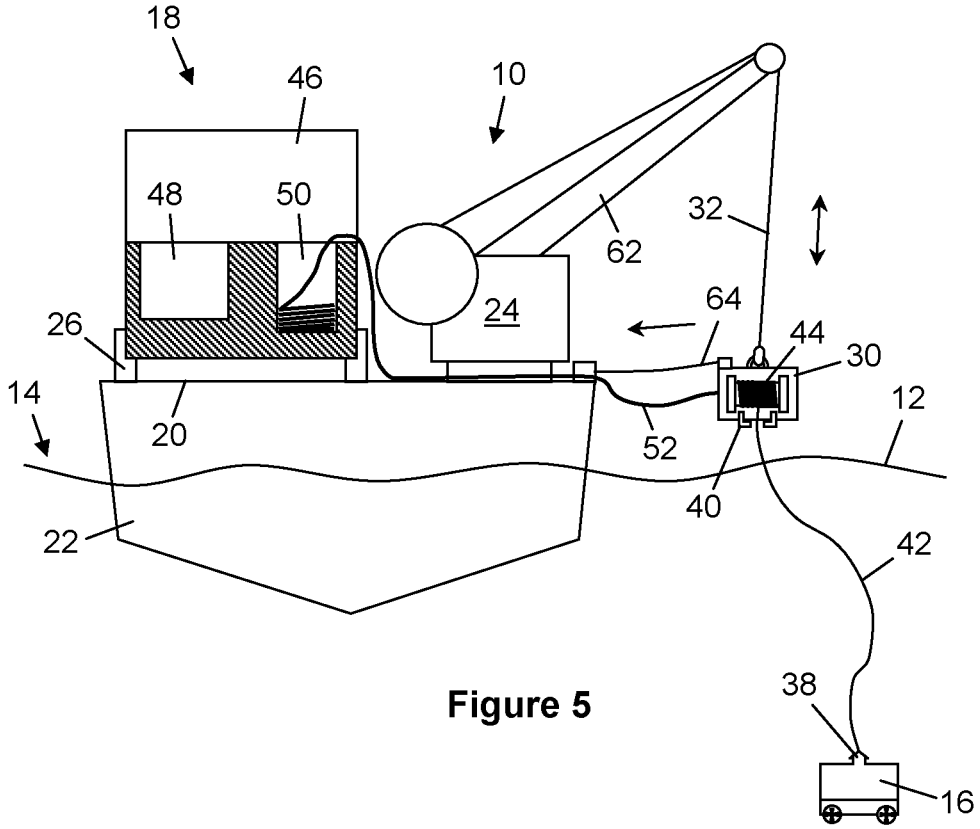
Figure 6:
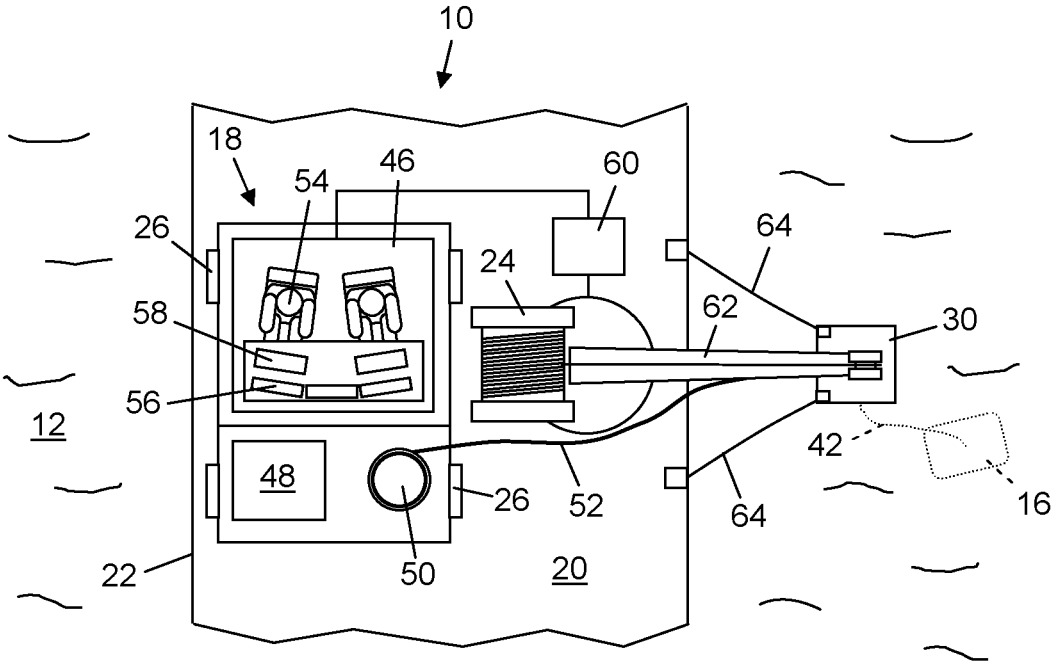
Figure 7:
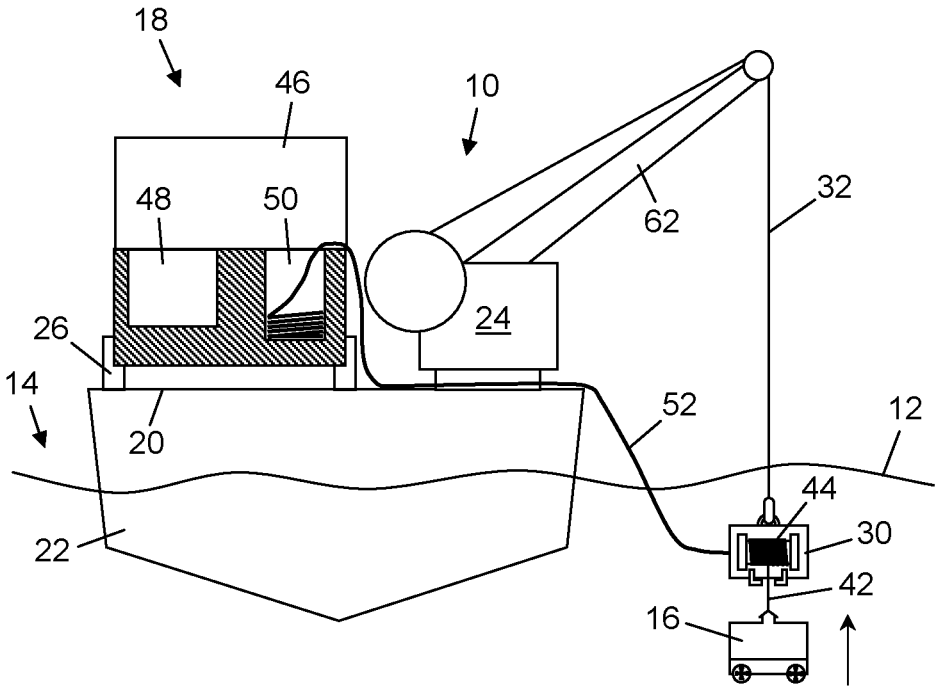
Figure 8:
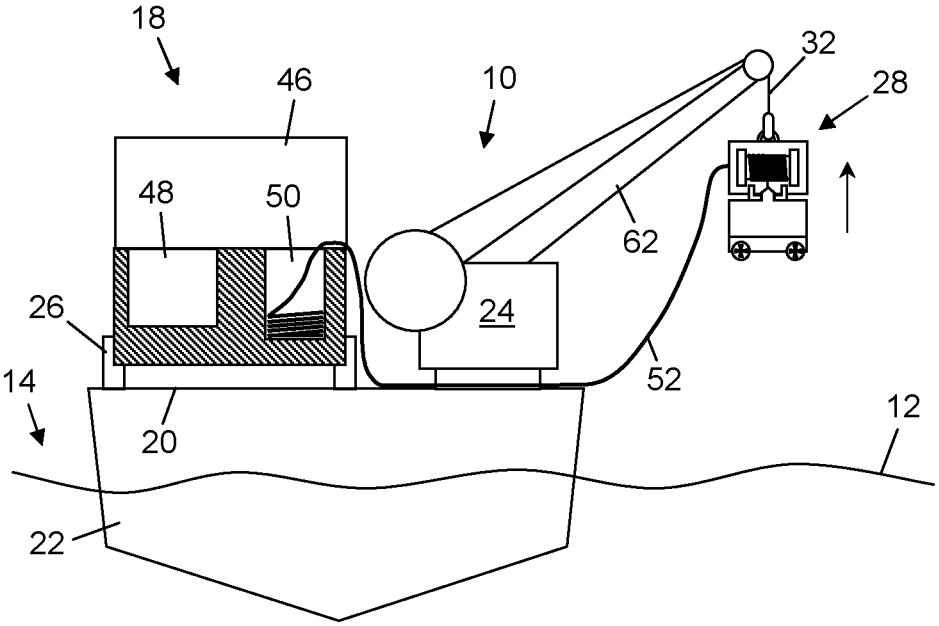

In order that the invention may be more readily understood, reference will now be made, by way of example, to the accompanying drawings in which:

FIG. 1 is a schematic part-sectional end view of a vessel of opportunity equipped in accordance with the invention, showing a crane of the vessel lifting a TMS/ROV assembly from a garage of a mobile ROV support unit placed on a working deck of the vessel;

FIG. 2 corresponds to FIG. 1 but shows the crane having slewed and then lowered the TMS/ROV assembly into the water beside the vessel;

FIG. 3 corresponds to FIG. 2 but shows the ROV undocking from the TMS under the water;

FIG. 4 corresponds to FIG. 3 but shows the TMS lifted back above the water by the crane while the ROV swims away to perform an underwater mission;

FIG. 5 corresponds to FIG. 4 but shows one of a pair of tag lines extending between the vessel and the suspended TMS to stabilise the TMS as the ROV performs the underwater mission;

FIG. 6 is a schematic top plan view corresponding to FIG. 5;

FIG. 7 corresponds to FIG. 3 but shows the ROV redocking with the TMS beneath the surface after completing the underwater mission; and FIG. 8 corresponds to FIG. 7 but shows the crane having lifted the TMS/ROV assembly clear of the water before slewing to return the assembly to the garage of the mobile support.

The schematic drawings, which are not to scale, show a vessel of opportunity 10 floating on the surface 12 of a body of water 14 such as the sea.

To operate a UUV exemplified here by an ROV 16, the vessel 10 is adapted in accordance with the invention by placing a transportable, self-contained ROV support unit 18 onto an open working deck 20 atop the hull 22 of the vessel 10. The ROV support unit 18 can be lifted aboard the vessel 10, for example using a crane 24 mounted on the working deck 20 of the vessel 10 or dockside, or may be driven onto or towed aboard the vessel 10.

In this example, the ROV support unit 18 is a mobile unit fitted with at least one pair of wheels 26 that enable the ROV support unit 18 to be positioned or repositioned at any convenient location on the working deck 20. The ROV support unit 18 may therefore be a vehicle, which may be a towable vehicle such as a trailer or a self-propelled vehicle such as a truck.

Once positioned on the working deck 20, the ROV support unit 18 may be tied down or anchored with suitable fastenings, such as chains or chocks, to ensure stability when the vessel 10 is at sea. Also, whilst the ROV support unit 18 could, in principle, provide its own electrical power from an on-board generator or from internal batteries, the ROV support unit 18 may conveniently be powered via a cable connection from an external source such as the electrical power system of the vessel 10. Such fastenings and power connections have been omitted from the drawings for simplicity.

The ROV support unit 18 hosts and supports a TMS/ROV assembly 28 that comprises a TMS 30 connected to the ROV 16. When not in use on a subsea mission, the ROV 16 is latched to the underside of the TMS 30 and hence is coupled mechanically and substantially rigidly to the TMS 30. Thus, the crane 24 can lift the TMS/ROV assembly 28 as a unitary load from the ROV support unit 18 into the water 14 before a mission and from the water 14 back to the ROV support unit 18 after the mission. The ROV support unit 18 therefore does not have, or need, its own crane or other lifting device.

When the ROV 16 is latched to the TMS 30 and the TMS/ROV assembly 28 is suspended in air on a wire 32 of the crane 24, the weight load of the ROV 16 is borne via the TMS 30. For this purpose, the TMS 30 is surmounted by a lifting formation on its upper side, such as a padeye 34, for engagement by a lifting tackle or a hook 36 suspended from the wire 32 of the crane 24.

When in the water 14, the ROV 16 can be unlatched and hence uncoupled mechanically from the TMS 30 to swim away from the TMS 30 to perform the mission. As is conventional, the ROV 16 is propelled to swim by on-board thrusters. After the mission, the ROV 16 swims back to or is pulled back to the TMS 30 to be latched and hence re-coupled mechanically to the TMS 30. Thus, the ROV 16 is surmounted on its upper side by a docking formation 38 that is engageable with a complementary remotely-operable latch formation 40 on the underside of the TMS 30.

While the ROV 16 is unlatched from the TMS 30 to swim underwater 14, the ROV 16 remains connected to the TMS 30 by a deployable, reelable tether 42. The tether 42 provides power and two-way data connections between the TMS 30 and the ROV 16, as required for the ROV 16 to perform the mission.

As is conventional, the TMS 30 comprises a reversible reel or winch 44 for deploying and retracting the tether 42 as appropriate. The length of the tether 42 deployed between the TMS 30 and the ROV 16 determines the maximum operational radius of the ROV 16 around and with respect to the TMS 30 for a given vertical separation between the ROV 16 and the TMS 30.

The ROV support unit 18 comprises an ROV control system 46, a garage 48 for the TMS/ROV assembly 28 and a storage location 50 for an umbilical 52. The umbilical 52 provides power and two-way data connections between the ROV control system 46 and the ROV 16 via the TMS 30 and the tether 42. The umbilical 52 is conveniently in a coiled configuration when it is stowed in the storage location 50, for example in a vertical-axis carousel, as shown, or on a reel.

The ROV control system 46 is exemplified here by an ROV van that accommodates ROV-operating personnel 54 such as pilots and/or other mission specialists. Displays 56 and control interfaces 58 provide for control inputs and for visual feedback between those personnel 54 and the ROV 16.

The plan view of FIG. 6 shows that the ROV control system 46 of the ROV support unit 18 is connected for data exchange with the control system 60 of the crane 24. This enables coordination between operation of the TMS/ROV assembly 28 and operation of the crane 24. In particular, the ROV control system 46 can control the crane 24 to lift the TMS/ROV assembly 28 into and out of the water 14 and to hold the TMS 30 steady by activating an optional heave compensation system of the crane 24.

In FIG. 1, the crane 24 is shown with its jib 62 slewed inboard to lift the TMS/ROV assembly 28 from the open-topped garage 48 of the ROV support unit 18. FIG. 2 shows the jib 62 then slewed outboard to lower the TMS/ROV assembly 28 into the water 14.

As the TMS/ROV assembly 28 is lifted away from the garage 48 and toward the water 14, the umbilical 52 is deployed by being pulled progressively out of the storage location 50 of the ROV support unit 18 as shown in FIG. 2. Deployment of the umbilical 52 is effected automatically, simply by pulling the umbilical 52 through the open top of the storage location 50. FIG. 2 shows that the deployed portion of the umbilical 52 lies on, and extends across, the working deck 20 and then hangs overboard between the working deck 20 and the suspended TMS/ROV assembly 28.

FIG. 2 also shows the TMS/ROV assembly 28 lowered into the water 14 to a depth of a few metres, advantageously beneath the potentially turbulent splash zone near the surface 12. The ROV 16 has substantially neutral buoyancy whereas the TMS 30 suitably has slightly negative buoyancy to maintain some tension in the wire 32 of the crane 24.

The ROV 16 is then undocked from the TMS 30, as shown in FIG. 3, to be free to swim to the depth required by the mission as shown in FIG. 4. FIG. 4 also shows that the wire 32 of the crane 24 is retracted to lift the TMS 30 clear of the water 14 while the ROV 16 performs the mission. The tether 42 is paid out by the reel 44 of the TMS 30 accordingly. The tether 42 then extends through the surface 12 of the water 14 between the TMS 30 and the ROV 16.

FIGS. 5 and 6 show the TMS 30 suspended on the wire 32 of the crane 24 above the surface 12 and, optionally, stabilised against swinging on or twisting about the wire 32 by a pair of tag lines 64 that act in tension between the TMS 30 and the hull 22 of the vessel 10. As can be appreciated in the plan view of FIG. 6, the tag lines 64 converge toward each other in the outboard direction toward the TMS 30 when viewed from above.

FIG. 5 also shows that the TMS 30 can optionally be moved up and down by a heave-compensation system that, cyclically, pays out and retracts the wire. This avoids heave, roll or pitch of the vessel 10 transmitting unwanted vertical forces to the ROV 16 via the tether 42. The heave-compensation system may conveniently be implemented in the control system 60 of the crane 24, shown in FIG. 6.

At the end of the mission, the TMS 30 is lowered back into the water 14 to a depth beneath the splash zone as shown in FIG. 7. The ROV 16 swims back to the TMS 30 as the TMS 30 retracts the tether 42 onto the reel 44. Alternatively, or additionally, retraction of the tether 42 onto the reel 44 of the TMS 30 can pull the ROV 16 toward the TMS 30.

Once the ROV 16 is docked again with the TMS 30, the TMS/ROV assembly 28 is lifted out of the water 14 as shown in FIG. 8 before the jib 62 of the crane 24 is slewed back inboard to lower the TMS/ROV assembly 28 into the garage 48 of the ROV support unit 18. The umbilical 52 is re-stowed in the storage location 50 of the ROV support unit 18, ready for future re-deployment as shown in FIGS. 1 and 2.

After use, the ROV support unit 18 can be lifted or driven off the vessel 10 to allow the vessel 10 to resume its primary duties. The ROV support unit 18 can then be used again on another vessel of opportunity. Alternatively, the ROV support unit 18 can be moved to a holding location elsewhere on the vessel 10 to be ready to support future ROV missions when required.

Many variations are possible within the inventive concept. For example, the ROV support unit could include a crane or hoist that is capable of lifting the TMS/ROV assembly into and out of the water. In that case, the vessel need not be fitted with a separate crane. Alternatively, a separate crane of the vessel need not be tied up when operating the ROV.

The ROV control system on board the ROV support unit could be a relay for conveying control data and visual feedback between the ROV and a separate master control unit, which could be located elsewhere on the vessel or indeed at another offshore or onshore location.

Elongate links other than tag lines, such as rods or other structures acting in tension or compression between the TMS and the vessel, could be used to stabilise the TMS when lifted clear of the water.

The ROV support unit could support two or more TMS/ROV assemblies or other subsea packages, each potentially with its own garage, umbilical and umbilical storage location or sharing an umbilical and an umbilical storage location. Alternatively, two or more ROV support units could be provided, each supporting a respective TMS/ROV assembly or other subsea package, conveniently with the option of sharing a common ROV control system between them. The crane of the vessel could thereby choose among a selection of ROVs or packages arrayed on the working deck of the vessel.

The invention claimed is:

1. A method of deploying an unmanned underwater vehicle (UUV) from a surface vessel or platform to perform a mission underwater, the method comprising:

moving the UUV, docked to a tether management system (TMS), outboard from the vessel or platform and into water beside the vessel or platform;

deploying an umbilical that extends outboard from the vessel or platform to the TMS to effect communication with the UUV via a tether of the TMS;

fully submerging the UUV in the water and then undocking the submerged UUV from the TMS;

swimming the UUV away from the TMS while deploying the tether, wherein swimming the UUV comprises propelling the UUV using one or more thrusters of the UUV; and while suspending the TMS over the water beside the vessel or platform, using the UUV to perform the mission while communicating with the UUV via the tether and the umbilical.

2. The method of claim 1, comprising also submerging the TMS in the water before undocking the UUV from the TMS and then lifting and holding the TMS clear of the water while the undocked UUV performs the mission.

3. The method of claim 1, comprising using a crane to lift the UUV and the TMS outboard from the vessel or platform and to suspend the TMS over the water.

4. The method of claim 3, wherein the crane is fitted to the vessel or platform.

5. The method of claim 1, comprising moving the suspended TMS up and down relative to the vessel or platform during the mission in compensation for heave of the vessel or platform.

6. The method of claim 1, comprising deploying the umbilical in response to outboard movement of the TMS from the vessel or platform.

7. The method of claim 6, comprising pulling the umbilical from a storage location by virtue of the outboard movement of the TMS.

8. The method of claim 1, comprising stabilising the suspended TMS with elongate links that extend from the vessel or platform to the TMS.

9. The method of claim 1, further comprising the preliminary step of positioning a mobile UUV support unit on a deck of the vessel or platform and then moving the UUV and the TMS from the UUV support unit outboard of the vessel or platform.

10. The method of claim 9, also comprising deploying the umbilical from storage on the UUV support unit.

11. The method of claim 9, also comprising communicating with the UUV via the UUV support unit.

12. The method of claim 11, comprising controlling the UUV from the UUV support unit.

13. The method of claim 1, further comprising the subsequent step of returning the UUV to the TMS after the mission, while retracting the tether, and then docking the UUV with the TMS.

14. The method of claim 13, comprising lowering the TMS into the water before docking the UUV with the TMS underwater.

15. The method of claim 1, wherein the UUV is deployed from a vessel of opportunity.

* * * * *